US009448034B2

(12) United States Patent
Downey et al.

(10) Patent No.: US 9,448,034 B2
(45) Date of Patent: Sep. 20, 2016

(54) RECOIL REDUCTION SYSTEM FOR FIREARM

(71) Applicant: Sturm, Ruger & Company, Inc., Southport, CT (US)

(72) Inventors: Matthias Downey, Warner, NH (US); Darrell Boyle, Newport, NH (US); Todd Wilkinson, Goshen, NH (US); Jonathan Barrett, Georges Mills, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/794,949

(22) Filed: Jul. 9, 2015

(65) Prior Publication Data

US 2016/0010944 A1 Jan. 14, 2016

Related U.S. Application Data

(60) Provisional application No. 62/022,461, filed on Jul. 9, 2014.

(51) Int. Cl.
*F41C 23/08* (2006.01)
*F41C 23/20* (2006.01)
(Continued)

(52) U.S. Cl.
CPC ..... *F41C 23/08* (2013.01); *F41C 23/06* (2013.01); *F41C 23/14* (2013.01); *F41C 23/20* (2013.01)

(58) Field of Classification Search
CPC ..... F41A 23/20; F41A 23/00; F41A 23/08; F41A 23/14; F41A 23/06; F41C 23/20; F41C 23/00; F41C 23/08; F41C 23/14; F41C 23/06
USPC ..... 42/73, 74
See application file for complete search history.

(56) References Cited

U.S. PATENT DOCUMENTS 287,741 A * 10/1883 Vickers ..... F41C 23/04 42/72
480,587 A * 8/1892 Jones et al. ..... F41C 23/08 42/74

(Continued)

FOREIGN PATENT DOCUMENTS

FR 470223 8/1914
FR 516596 4/1921

(Continued)

OTHER PUBLICATIONS

Corresponding International Search Report and Written Opinion for PCT/US15/39648 dated Feb. 23, 2016.

*Primary Examiner* — Stephen M Johnson
(74) *Attorney, Agent, or Firm* — The Belles Group, P.C.

(57) ABSTRACT

A user-adjustable recoil reduction system for a firearm includes a buttstock and a butt pad assembly movably mounted to the buttstock. A spring is disposed in the buttstock which is acted on by opposing front and rear spring guides. A preload adjustment screw is rotatably coupled to the butt pad assembly which engages the rear spring guide. Rotating the screw in opposing directions alternatingly advances or retracts the rear spring guide in the buttstock. Advancing the rear spring guide compresses the spring to set a first spring preload condition and retracting the rear spring guide relaxes the spring to set a second spring preload condition different than the first condition. The spring preload conditions may be selected to match firing light or heavy type ammunition shell loads. In one embodiment, the adjustment screw is accessible for adjusting the preload without removing the butt pad assembly from the buttstock.

23 Claims, 18 Drawing Sheets

(51) Int. Cl.
*F41C 23/14* (2006.01)
*F41C 23/06* (2006.01)

(56) References Cited

U.S. PATENT DOCUMENTS

| | | | |
|---|---|---|---|
| 910,276 | A | 1/1909 | Easdale |
| 1,379,989 | A | 5/1921 | Johnson |
| 2,426,563 | A | 8/1947 | Patchett |
| 2,779,249 | A | 1/1957 | Saetter-Lassen |
| 3,233,354 | A | 2/1966 | Ahearn |
| 3,290,815 | A | 12/1966 | Edwards |
| 3,381,405 | A | 5/1968 | Edwards |
| 3,410,175 | A | 11/1968 | Johnson et al. |
| 3,707,797 | A | 1/1973 | Ruth |
| 4,279,091 | A | 7/1981 | Edwards |
| 4,667,566 | A | 5/1987 | Bosshard et al. |
| 4,910,904 | A | 3/1990 | Rose |
| 5,031,348 | A | 7/1991 | Carey |
| 5,392,553 | A | 2/1995 | Carey |
| 5,909,002 | A | 6/1999 | Atchisson |
| 5,941,005 | A | 8/1999 | Battaglia et al. |
| 5,974,718 | A | 11/1999 | Bentley et al. |
| 5,983,549 | A | 11/1999 | Battaglia |
| 6,481,143 | B2 | 11/2002 | McCarthy |
| 6,732,466 | B2 | 5/2004 | Bentley |
| 6,829,974 | B1 | 12/2004 | Gwinn, Jr. |
| 7,478,495 | B1 | 1/2009 | Alzamora et al. |
| 7,493,845 | B2 | 2/2009 | Mantas |
| 7,926,216 | B2 | 4/2011 | Bentley |
| 7,984,580 | B1 | 7/2011 | Giauque et al. |
| 8,176,668 | B2 | 5/2012 | Simms et al. |
| 8,413,361 | B2 | 4/2013 | Quaedpeerds et al. |
| 8,505,226 | B2 | 8/2013 | Vesligaj |
| 2010/0071246 | A1 | 3/2010 | Vesligai |
| 2010/0122482 | A1 | 5/2010 | Simms et al. |
| 2010/0275482 | A1 | 11/2010 | Bentley |
| 2011/0138668 | A1 | 6/2011 | Thomas |
| 2014/0059909 | A1 | 3/2014 | Caudle |
| 2014/0109452 | A1 | 4/2014 | Baker |
| 2014/0123528 | A1 | 5/2014 | Vesligaj |

FOREIGN PATENT DOCUMENTS

| | | |
|---|---|---|
| FR | 2645952 | 10/1990 |
| GB | 573694 | 12/1945 |
| GB | 836796 | 6/1960 |

* cited by examiner

RECOIL REDUCTION SYSTEM FOR FIREARM

CROSS-REFERENCE TO RELATED APPLICATIONS

The present application claims the benefit of priority to U.S. Provisional Application No. 62/022,461 filed Jul. 9, 2014, the entirety of which is incorporated herein by reference.

BACKGROUND

The present invention generally relates to firearms, and more particularly to systems for reducing felt recoil from discharging the firearm.

A recoil force is generated when a firearm is discharged. The bullet or slug and high pressure combustion gases generated exit the muzzle end of the barrel in a forward direction at considerable velocity. This creates a recoil force which drives the firearm in an opposite rearward direction towards the shooter (user) under the principles of momentum. The recoil force generated is substantially equal to the forward discharge force of the propellant gases. Various firearm recoil reduction approaches have been used.

When firing a long gun such as a rifle or shotgun which may use somewhat high power ammunition, the felt recoil may especially be significant and uncomfortable for the user. In addition, this may make it more difficult to reacquire a target and fire a second shot accurately. In the case of a shotgun, a user may also sometimes find it desirable to alternate between firing light load shotshells on some occasions and heavy load shotshells on other occasions depending on the type of target shooting and/or hunting activity planned. This also is applicable to switching between different cartridges in a rifle for firearms provided with this capability.

Accordingly, it is therefore desirable to at least partially abate and lessen the recoil forces acting against the user's arms and shoulder against which the buttstock of a rifle or shotgun is typically abutted. It is also further desirable to have the ability to adjust a recoil adjustment system for a shotgun or rifle to accommodate firing different type loads.

SUMMARY

A recoil reduction system is provided for a firearm which may be mounted in the buttstock of a rifle or shotgun. The system includes a spring suppression mechanism to dampen felt recoil. In one embodiment, the recoil reduction system includes a user-tunable adjustment feature allowing the suppression or dampening capacity of the system to be changed to accommodate firing different types of loads.

According to an aspect of the invention, an adjustable recoil reduction system for a firearm includes: an axially extending buttstock having a longitudinal stock axis, a rear end, a front end, and a longitudinally extending internal cavity; a ram including a cantilevered mounting extension, the mounting extension projecting forward from the ram through the rear end of the buttstock into the internal cavity, the mounting extension slideably coupling the ram to the buttstock; a butt pad coupled to the ram; an adjustable plunger assembly comprising a rear spring guide disposed in the buttstock and a preload adjustment screw rotatably coupled to the ram and engaging the rear spring guide, the plunger assembly being movable forward and rearward in the buttstock; and a first compression spring mounted inside the buttstock and engaged by the rear spring guide, the plunger assembly operating to compress the first compression spring when the buttstock moves rearward relative to the plunger assembly; wherein rotating the adjustment screw in a first direction advances the rear spring guide and compresses the first compression spring for setting a first preload condition, and rotating the adjustment screw in an opposite second direction retracts the rear spring guide and allows the first compression spring to expand for setting a second preload condition; wherein when a rearward acting recoil force is generated by discharging the firearm, the buttstock moves rearward and compresses the first compression spring against the plunger assembly to absorb at least a portion of the recoil force.

According to another aspect of the invention, an adjustable recoil reduction system for a firearm includes: a buttstock extending rearward from a receiver, the buttstock having a longitudinal stock axis, a rear end, a front end, and an internal cavity extending between the front and rear ends; a spring assembly disposed in the buttstock, the spring assembly comprising a tubular sleeve fixedly mounted inside the buttstock, a first spring inside the sleeve, a second spring inside the sleeve concentrically arranged around the first spring, a rear spring guide engaged with the first and second springs, and a front spring guide engaged with the first and second springs; a butt pad assembly comprising a butt pad configured for placement against a shoulder of a user and a ram coupled to butt pad, the butt pad assembly movably coupled to the buttstock; an axially elongated preload adjustment screw threadably coupled to the ram and having a front end engaging the rear spring guide to fix a position of the rear spring guide relative to the sleeve, the preload adjustment screw movable forward and rearward relative to the buttstock by rotating the preload adjustment screw in opposing directions; wherein rotating the preload adjustment screw in a first direction compresses the first and second springs to set a first preload condition, and rotating the preload adjustment screw in an opposite second direction expands the first and second springs to set a second preload condition; wherein when a rearward acting recoil force is generated by discharging the firearm, the buttstock moves rearward and the rear spring guide compresses the first and second springs thereby absorbing at least a portion of the recoil force.

A method for reducing recoil in a firearm includes: providing a firearm including a buttstock, a butt pad assembly movably coupled to a rear end of the buttstock, a coiled first spring disposed inside the buttstock, and an adjustable plunger mechanism comprising a rear spring guide engaging the compression spring and a preload adjustment screw rotatably coupled to the butt pad assembly and engaging the rear spring guide, the buttstock being in a forward non-recoil position spaced apart from the butt pad assembly by a first distance; rotating the preload adjustment screw in a first direction which advances the rear spring guide forward in the buttstock; compressing the first spring by the advancement of the rear spring guide to a first preload condition; discharging the firearm; moving the buttstock in a rearward direction under recoil closer to the butt pad, the buttstock being in a rearward recoil position spaced apart from the butt pad assembly by a second distance smaller than the first distance; the buttstock compressing the first spring by movement in the rearward direction; expanding the first spring; and returning the buttstock to the forward non-recoil position.

Further areas of applicability of the present invention will become apparent from the detailed description provided hereinafter.

BRIEF DESCRIPTION OF THE DRAWINGS

The features of the exemplary embodiments will be described with reference to the following drawings where like elements are labeled similarly, and in which.

Figure 1:
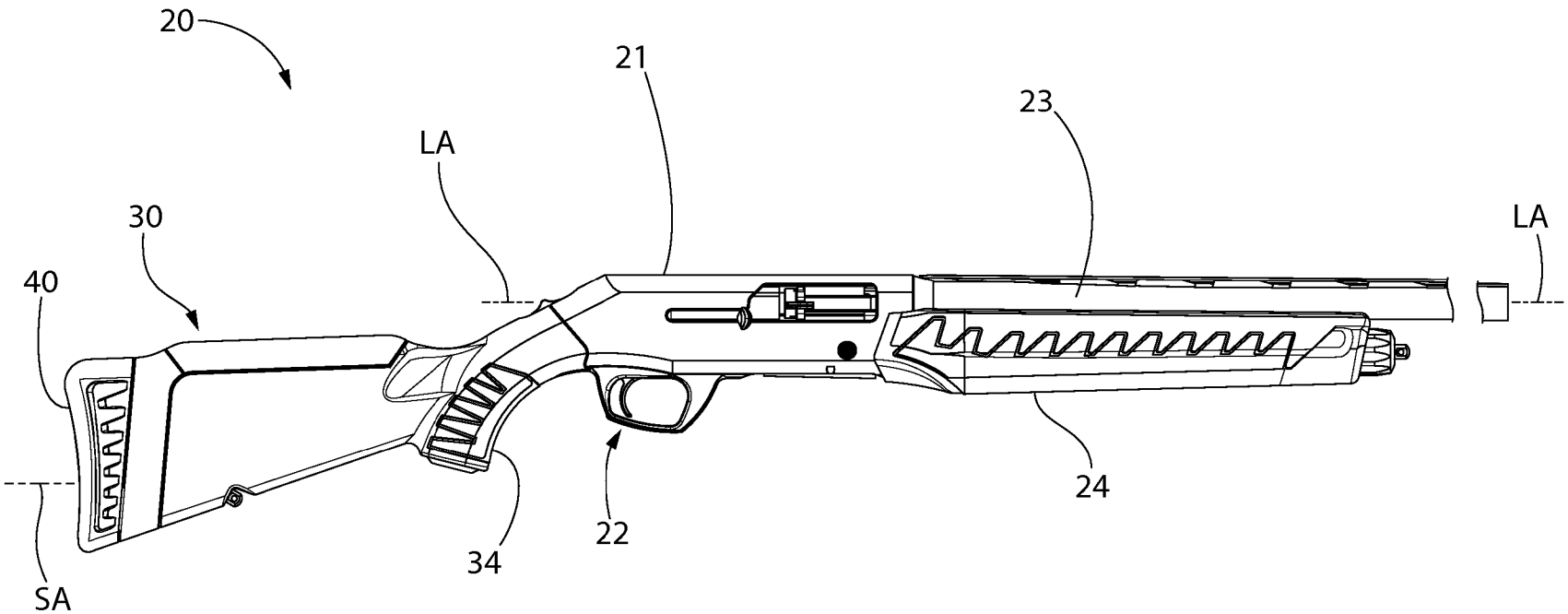
FIG. 1 is a longitudinal side view of one exemplary embodiment of a firearm including an adjustable recoil mechanism according to the present disclosure.
Figure 2:
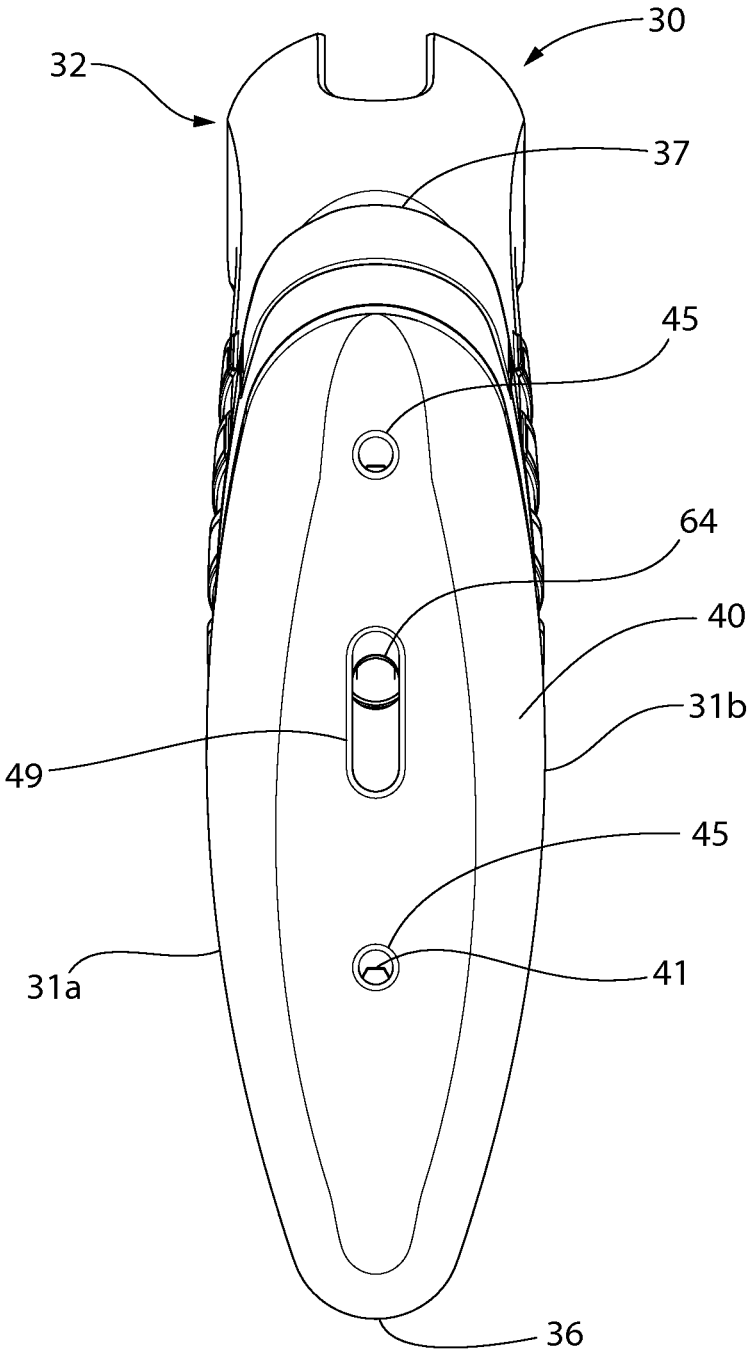
FIG. 2 is a rear end view thereof.
Figure 3:
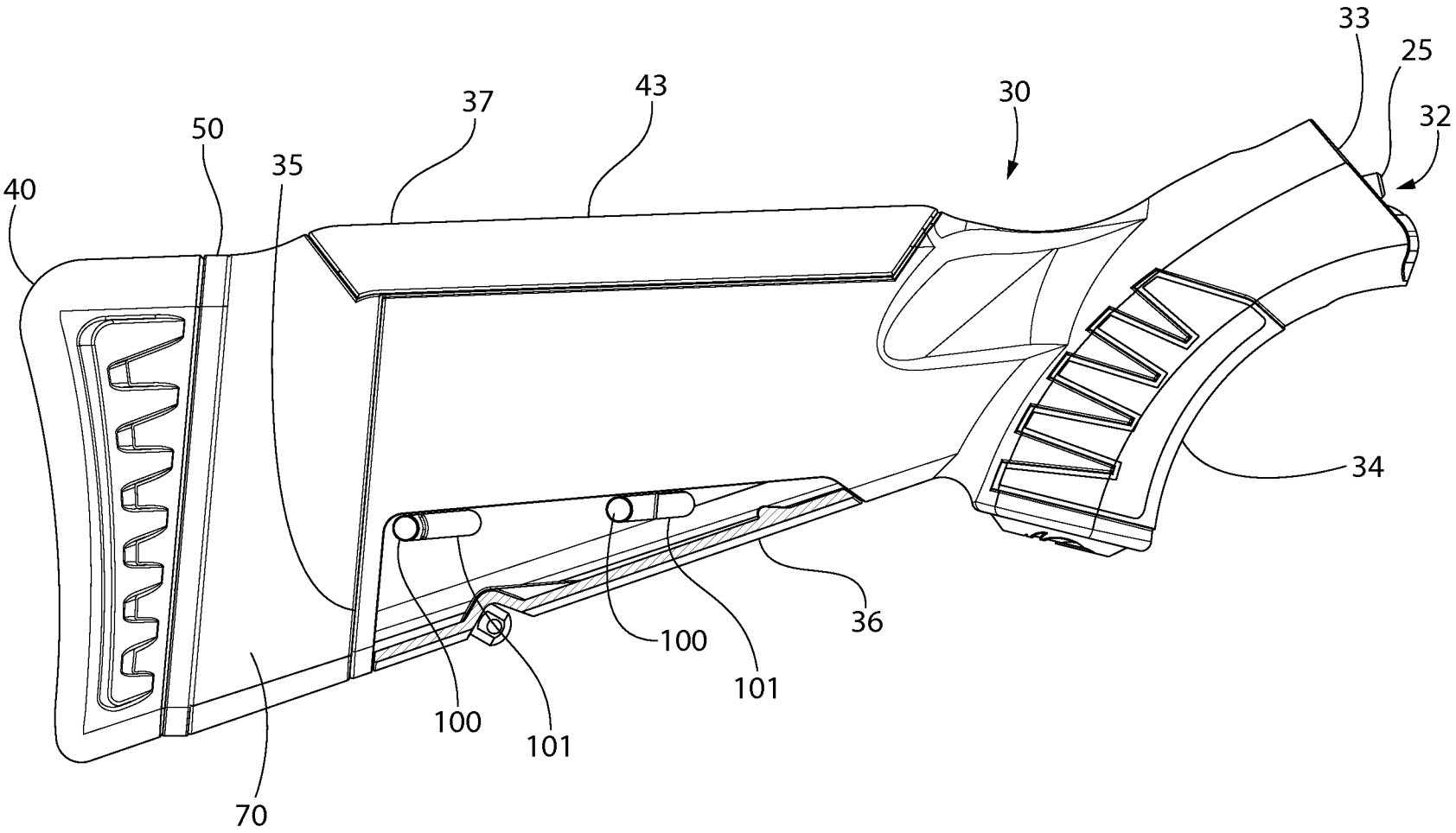
FIG. 3 is a side elevation view of the buttstock of the firearm of FIG. 1 with detachable bottom cover removed.

All drawings are schematic and not necessarily to scale. Parts given a reference numerical designation in one figure may be considered to be the same parts where they appear in other figures without a numerical designation for brevity unless specifically labeled with a different part number and/or described herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The term "action" is used herein in its conventional sense in the firearm art as meaning the mechanism that loads and ejects shells into/from the firearm and opens and closes the breech (i.e. the area in the receiver between an openable/closeable breech face on the front of the bolt and the rear face of the barrel chamber).

FIG. 1 is a longitudinal side elevation view of a firearm 20 having a recoil reduction system according to the present disclosure. The recoil reduction system may be a spring-type recoil suppression system in one embodiment, as further described herein. Firearm 20 includes a receiver 21, a trigger assembly 22 coupled to the receiver, a barrel 23 supported by the receiver, a forearm 24 extending forward from the receiver beneath the barrel for grasping by a user's hand, and buttstock 30 extending rearward from the receiver for placement against the user's shoulder when aiming the firearm held in a ready-to-fire position to acquire a target. The firearm 20 defines a longitudinal axis LA and axial direction coinciding with the centerline of the barrel 23 and its longitudinal bore formed therein (not shown). Firearm 20 may be any type of long gun, including a rifle or a shotgun.

Referring now to FIGS. 2-5 and 10, the buttstock 30 (or stock) in one embodiment is a substantially hollow and axially elongated structure having an opposing right sidewall 31*a* and left sidewall 31*b*, a front end 32 terminating at grip 34 and receiver mounting portion 33, an at least partially open rear end 35, a bottom 36, and a top 37. The sidewalls 31*a*, 31*b* define a longitudinally and axially extending internal cavity 38 for housing components of the recoil reduction system. In one embodiment, the rear end 35 may be at least partially open to access the cavity 38 and allow insertion of the recoil reduction system components shown in FIGS. 4A-B. The buttstock defines a stock axis SA which is offset from but parallel to longitudinal axis LA, both of which define axial directions.

A butt or recoil pad 40 is mounted on rear end of the buttstock. The butt pad 40 may be made of an energy absorbing resilient deformable material, such as for example without limitation foam, gel, rubber, or other material. In other embodiments the butt pad may be made of a rigid material (e.g. hard plastic, wood, etc.). A longitudinally extending cheek rest or comb 43 is mounted on the top 37 of the buttstock 30 for placement against a user's cheek when holding the firearm 20 in the ready-to-fire aiming position. In one embodiment, the comb 43 is fixedly attached to the buttstock 30 so that the comb moves rearward with the buttstock under recoil as a unit. Buttstock 30 may further include a removable bottom cover 30*a* which provides access for mounting the butt pad assembly to the buttstock, as further described herein.

Referring to FIGS. 2-5, the recoil reduction system is comprised of a "stationary" group of components and a "moving" group of components which are configured to interact under recoil to suppress and dampen the felt recoil experienced by a user. The terms "stationary" and "moving" refer to those components that either remain relatively immobile or are in motion respectively under recoil after the firearm is discharged.

The stationary components generally comprise the butt pad 40, hard insert 42, spacer plate 50, ram 60, skirt 70, skirt retaining plate 110, fasteners 41, and preload adjustment mechanism comprising a preload adjustment screw 80, and transverse dowel pins 100. Collectively, these components may be considered to form a "butt pad assembly" 40*a* which removably mounts to the rear end of the buttstock 30. In use, these butt pad components are buttressed by a user's shoulder and remain relatively stationary with respect to the moving components recognizing that the user's body will naturally undergo some slight motion and deformation due to the recoil forces generated.

Butt pad 40 may be overmolded onto hard insert 42 which provides a rigid structure or backbone for securing the more resilient pad to ram 60 via threaded fasteners 41 that extend through corresponding holes formed in the skirt retaining plate 110 and spacer plate 50 interspersed between the butt pad and ram. The fasteners 41 each engage a corresponding threaded socket 44 disposed in the ram. In some embodiments, the sockets 44 may be formed in threaded metallic inserts disposed in upper and lower longitudinal passages 44*b*, 44*a* formed in the ram 60. In other embodiments, the longitudinal passages 44*a*, 44*b* may themselves instead be internally threaded to receive the threaded stem of the fasteners 41. Either arrangement may be used. It bears noting that in certain embodiments where the butt pad 40 is formed of a relatively rigid material, the hard insert 42 may be omitted. Butt pad 40 may include through holes 45 used to access the heads of fasteners 41 for installing and removing the butt pad from the stock 30. Accordingly, butt pad in such an embodiment is removably attached to the buttstock and readily replaceable.

Hard insert 42 may be made of a suitably rigid material, including without limitation hard plastic, metal (e.g. aluminum, titanium, steel, etc.), composites, etc. Butt pad 40 may have a vertically elongated oblong shape which is configured and contoured to abuttingly engage a user's shoulder. Hard insert 42 may have a similar complementary shape in some embodiments (see, e.g. FIG. 5). Hard insert 42 may be shorter in height than the buttstock 40 and not visible when the butt pad 40 is mounted to the buttstock 30.

With continuing reference to FIGS. 2-5, the butt pad 40 is abuttingly engaged with the spacer plate 50 which may be in the form of a vertically oriented oblong straight plate in one embodiment. Spacer plate 50 may in turn abuttingly engage the skirt retaining plate 110 interspersed between the spacer and ram as illustrated. The skirt retaining plate 110 may have a vertically oblong shape similar to spacer plate 50. The skirt retaining plate 110 preferably has a height substantially the same as the forward end portion of butt pad 40 as shown to create a relatively flush transition on the exterior surface of the buttstock transition. Skirt retaining plate 110 has a height slightly smaller than the spacer plate 50 and is not accessible or visible after assembly of the butt pad assembly 40*a* to the buttstock 30 (see, e.g. FIG. 4A). The butt pad 40, spacer plate 50, and skirt retaining plate 110 are mutually configured and dimensioned to be generally similar and complementary in shape and dimension (height and width).

Figure 6A:
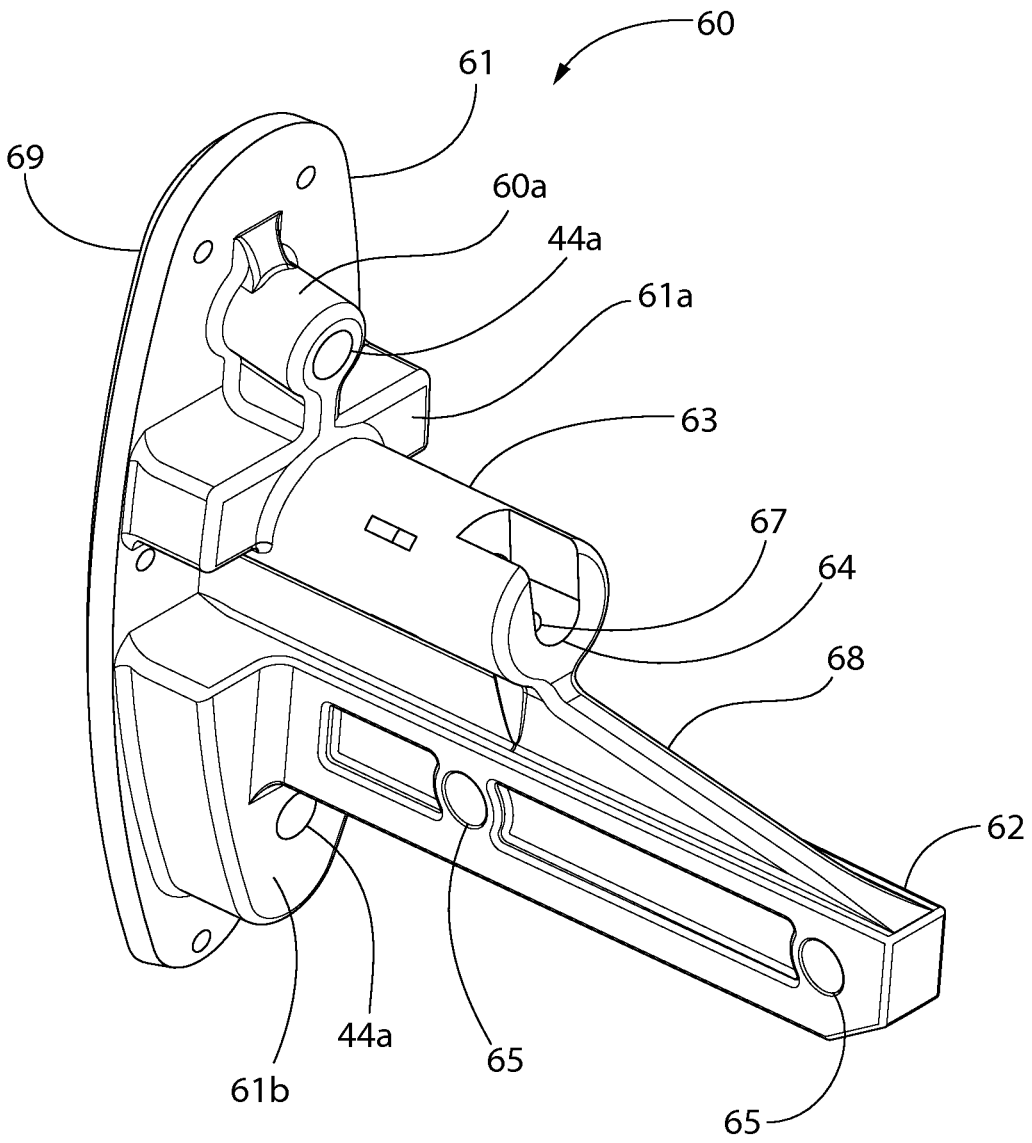
FIGS. 6A-D are perspective, side, rear, and front views respectively of the ram shown in FIGS. 4A-B.
Figure 6B:
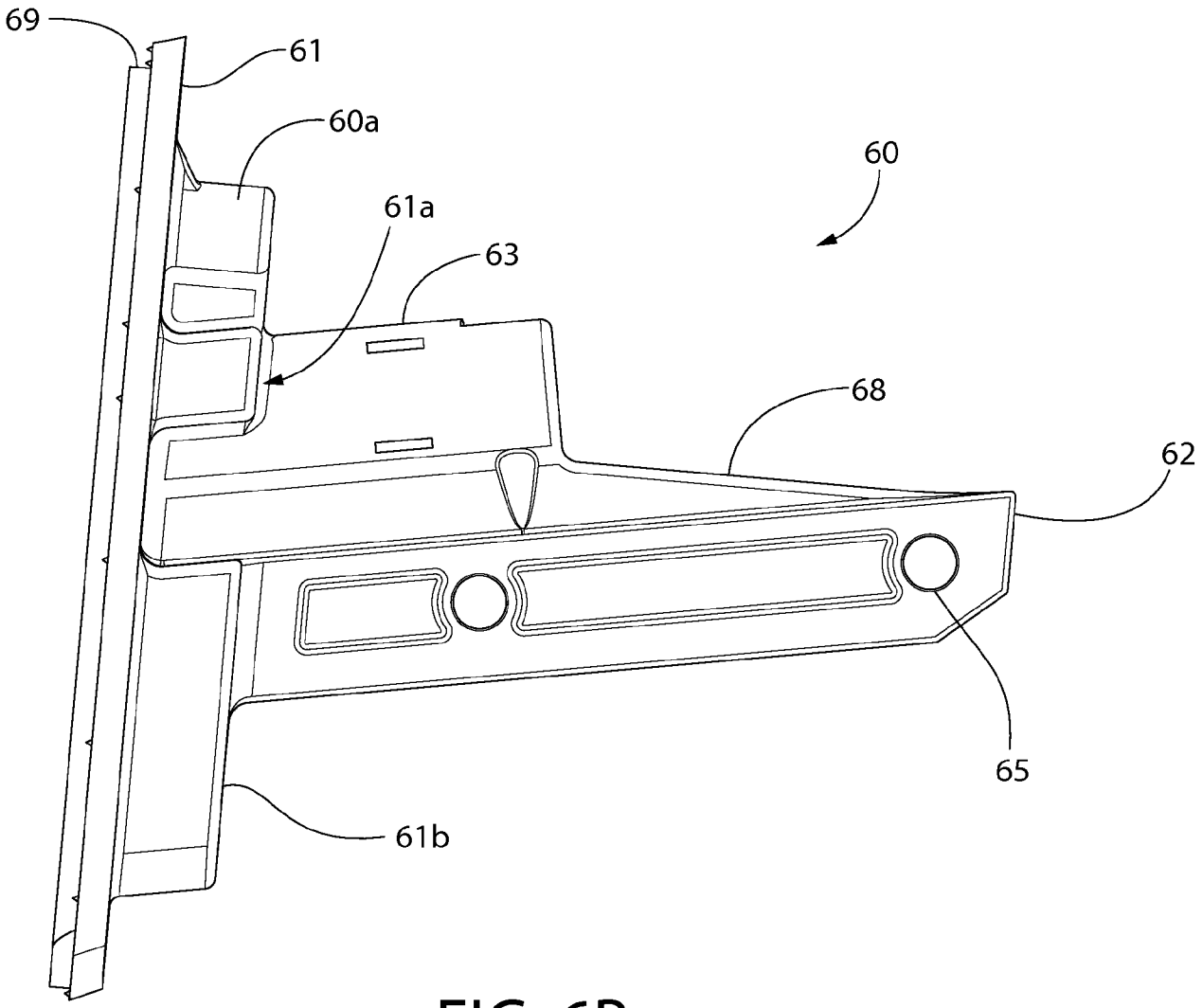
Figure 6D:
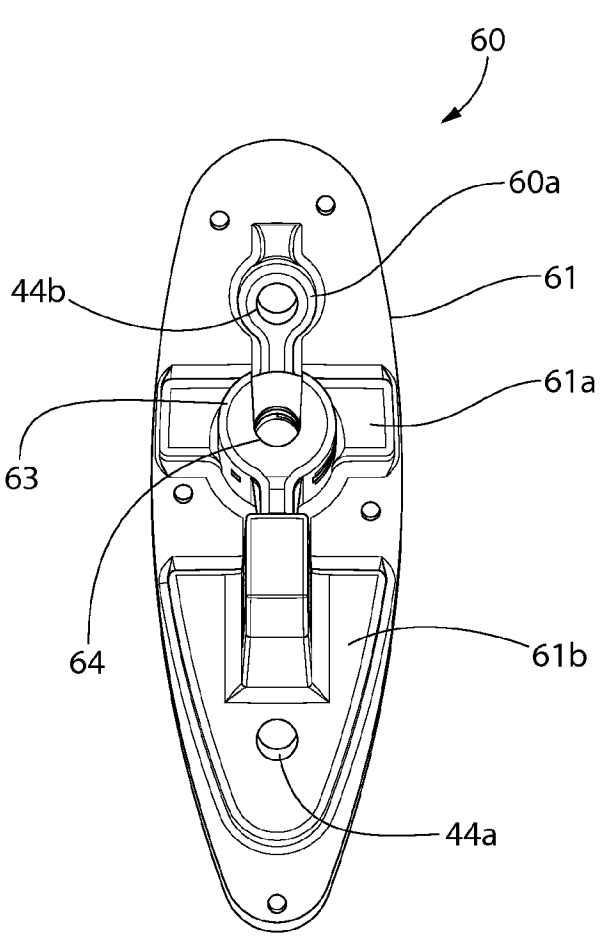
Figure 6C:
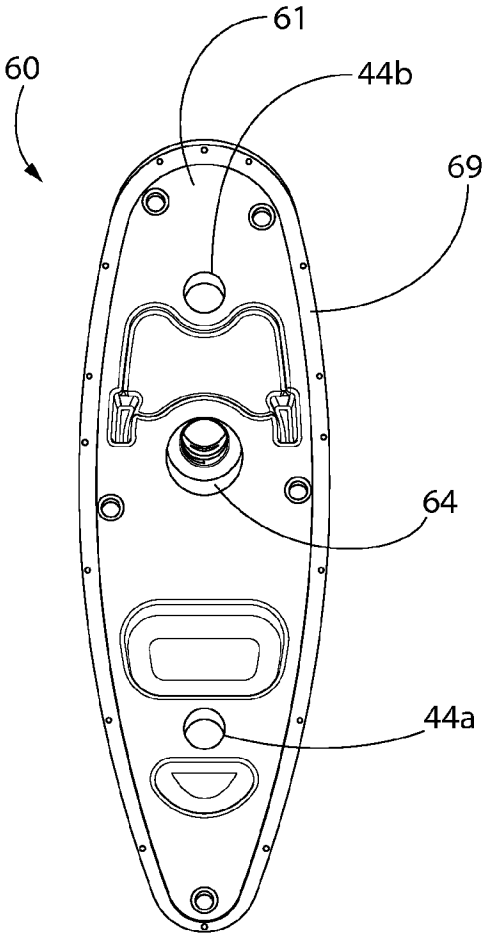
Figure 7A:
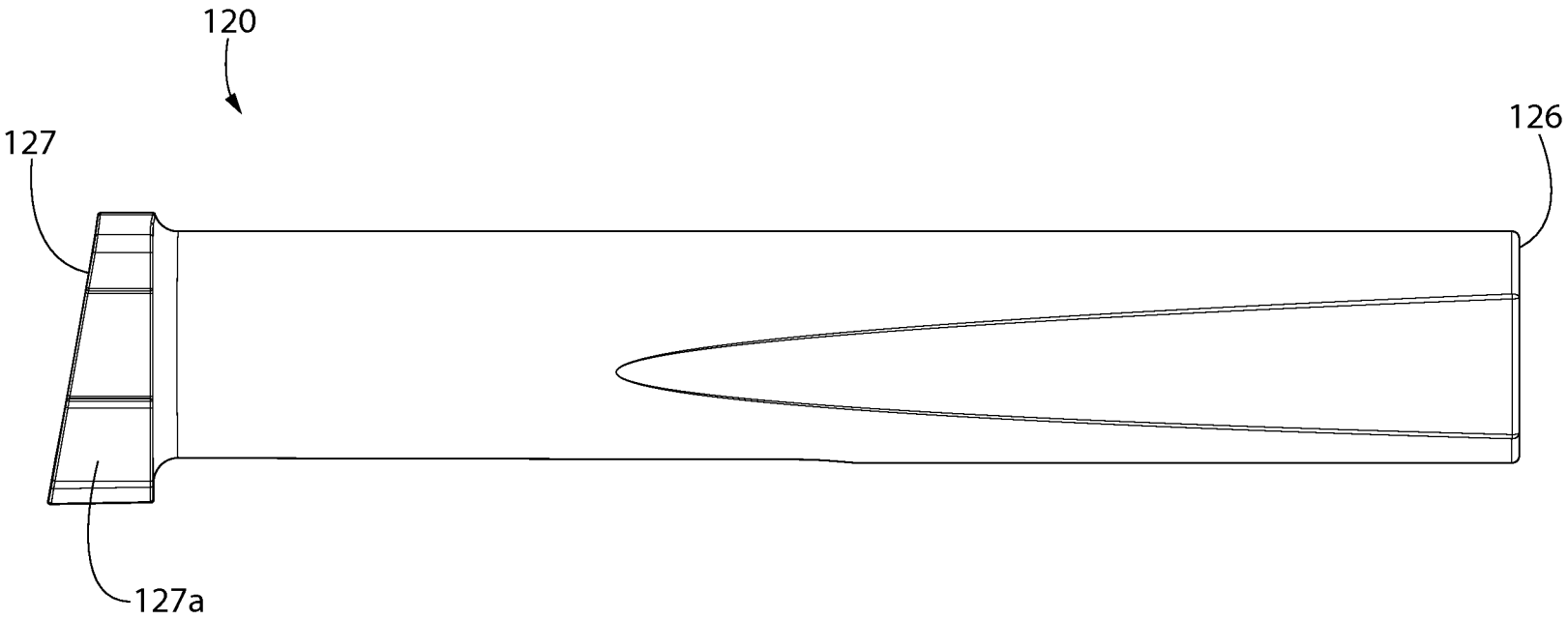
FIGS. 7A-D are side, rear, front, and cross-sectional views respectively of the spring tube shown in FIGS. 4A-B.
Figure 7B:
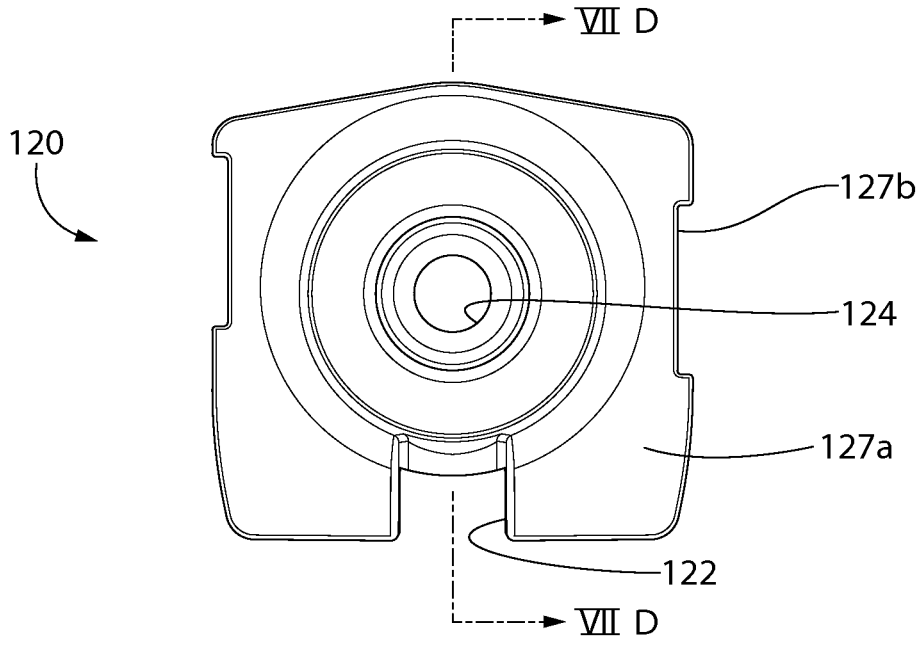
Figure 7C:
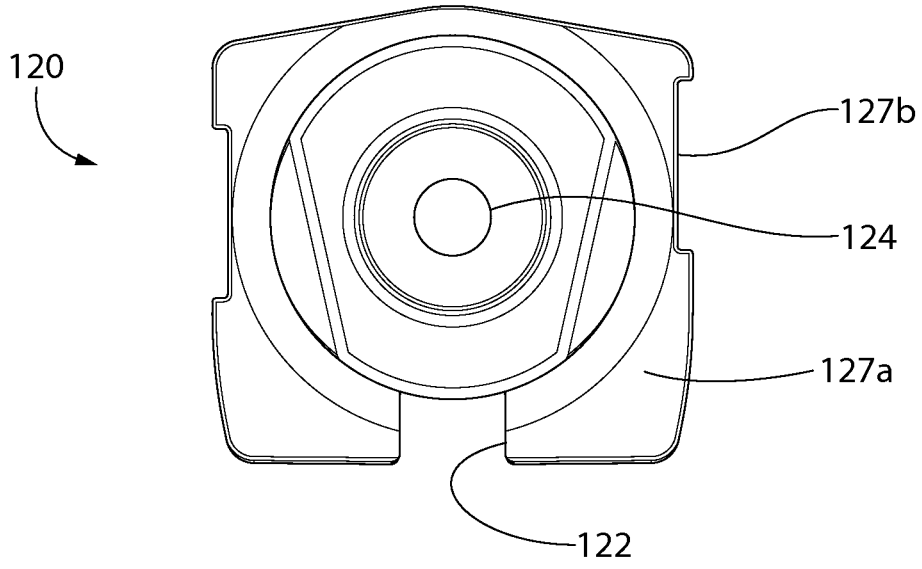
Figure 7D:
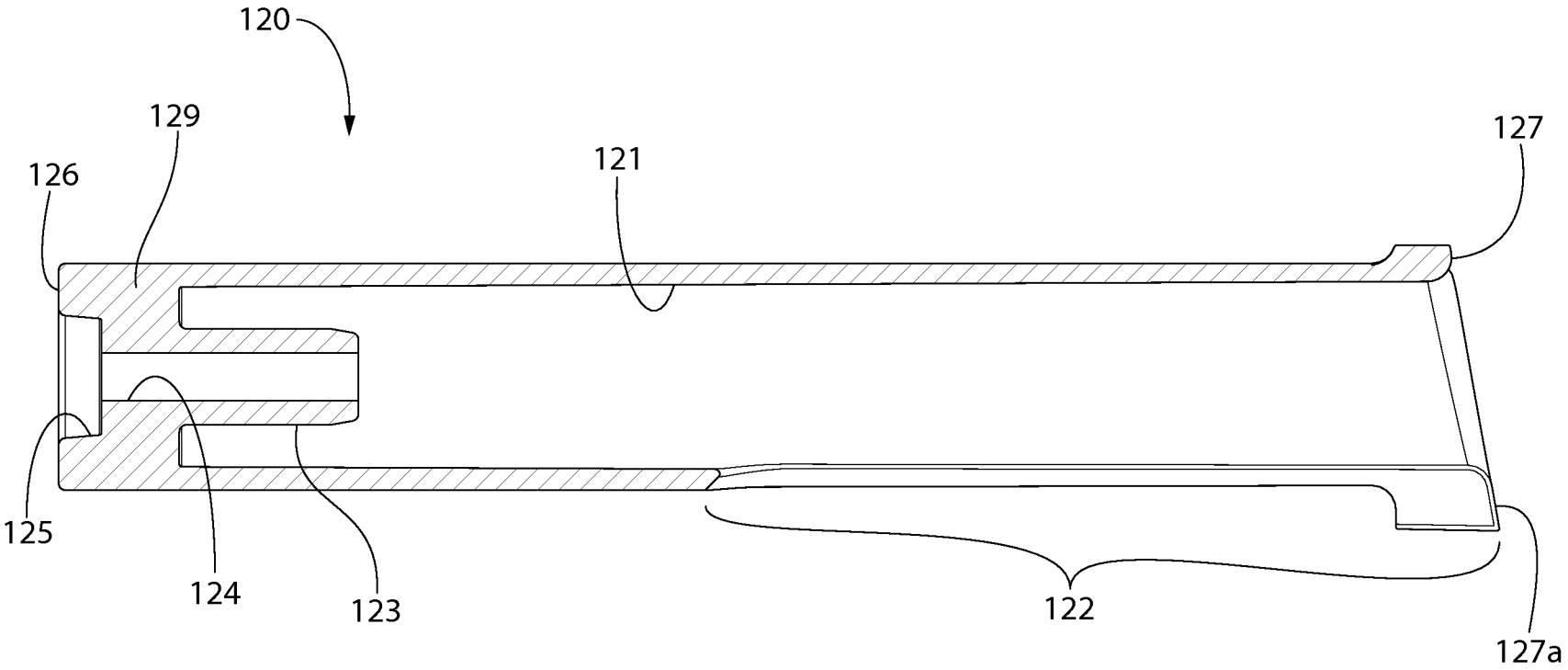
Figure 8A:
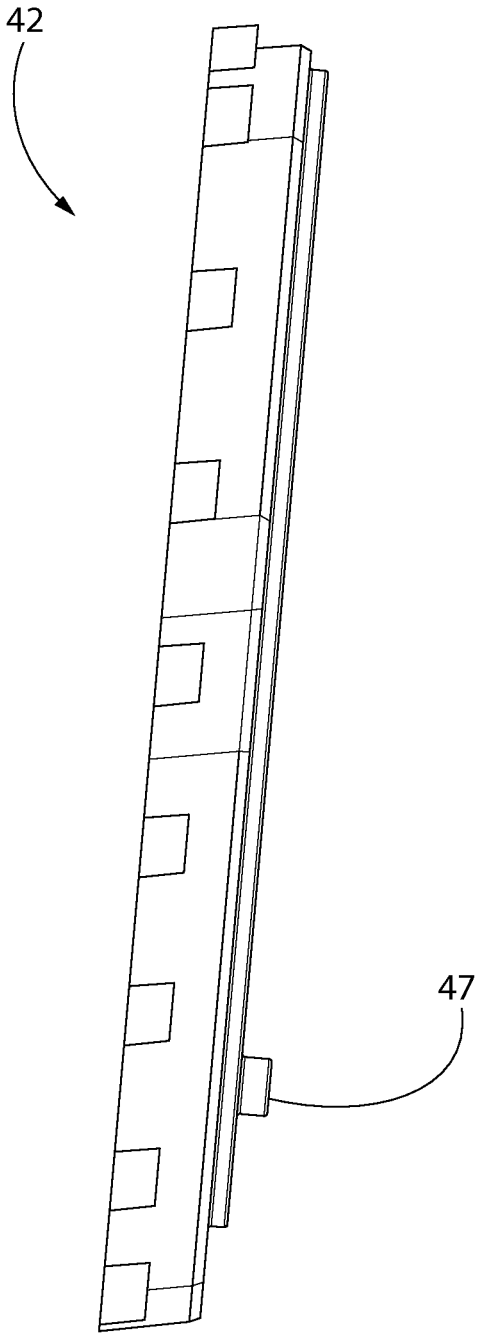
FIGS. 8A-C are side, rear perspective, and front perspective views respectively of the butt pad hard insert shown in FIGS. 4A-B.
Figure 8C:
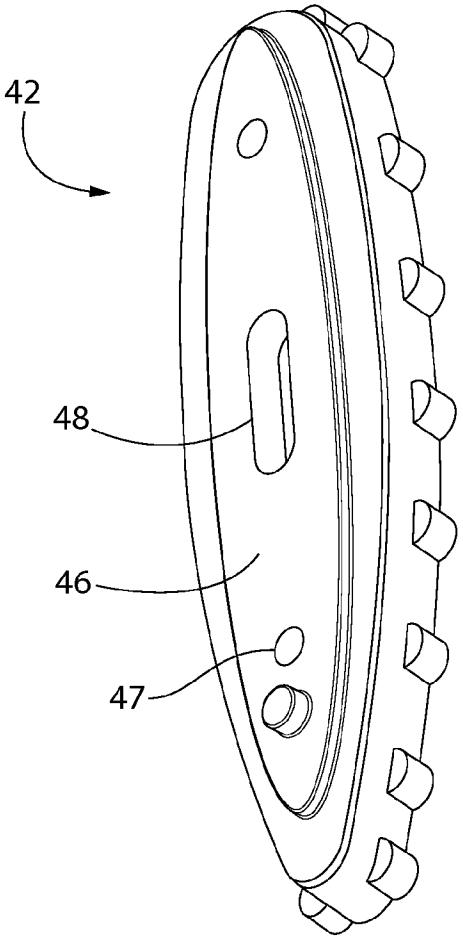
Figure 8B:
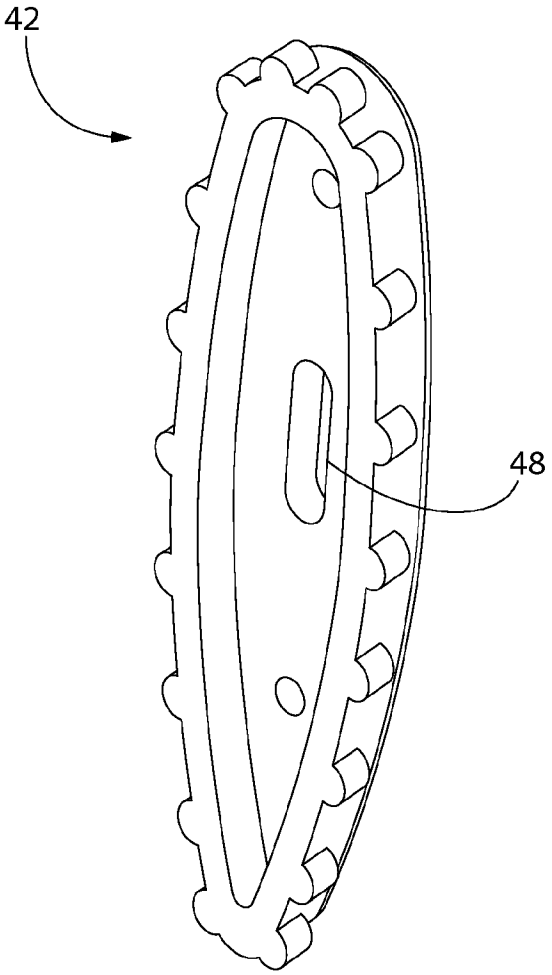
Figure 9C:
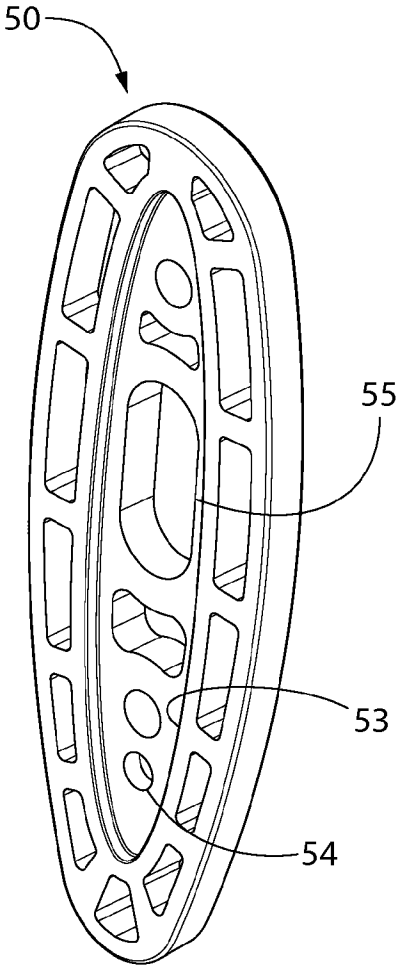
FIGS. 9A-C are front perspective, front, and rear perspective views respectively of the spacer plate shown in FIGS. 4A-B.
Figure 9B:
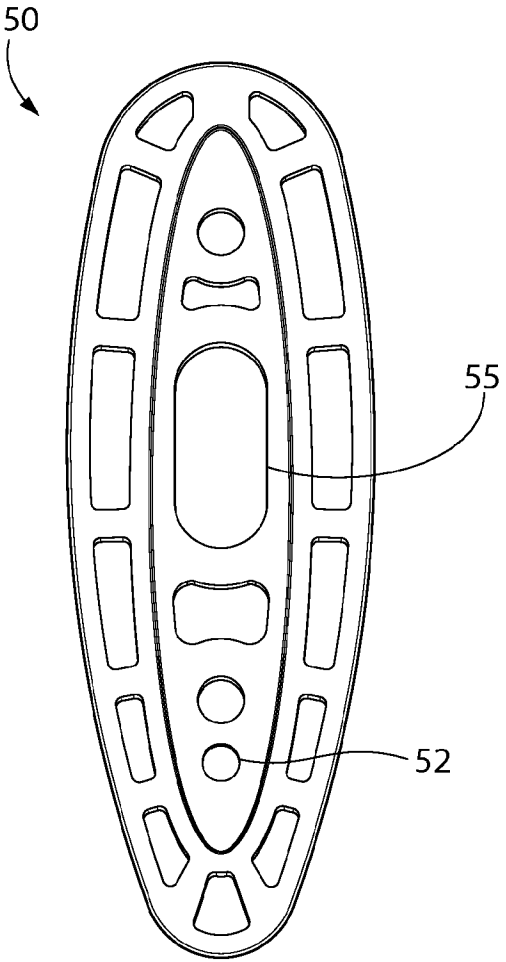
Figure 9A:
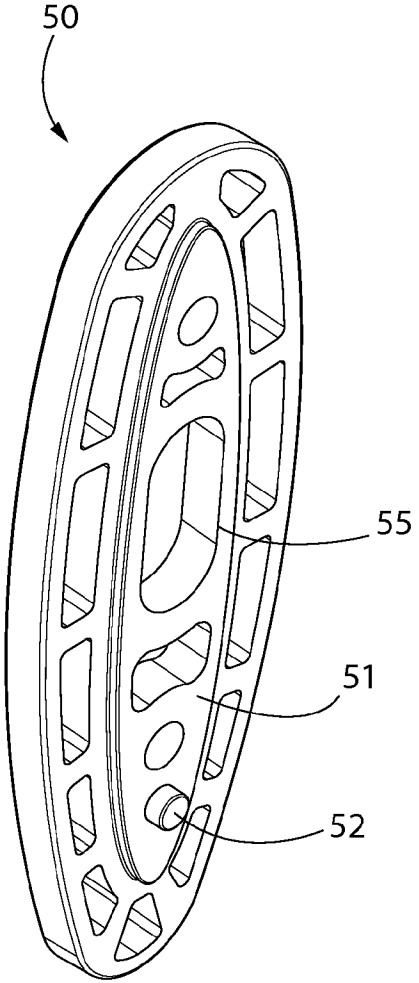
Figure 10B:
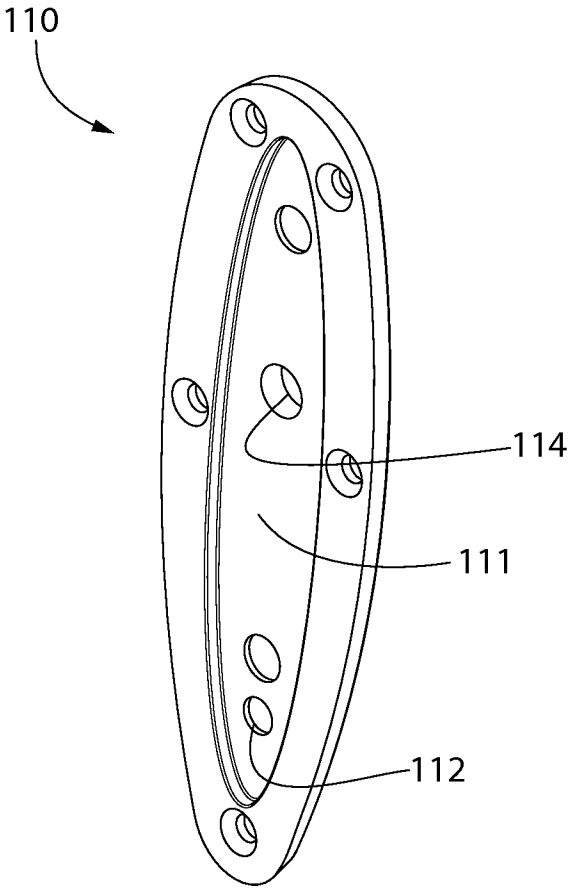
FIGS. 10A-B are front and rear perspective views respectively of the skirt retaining plate shown in FIGS. 4A-B.
Figure 10A:
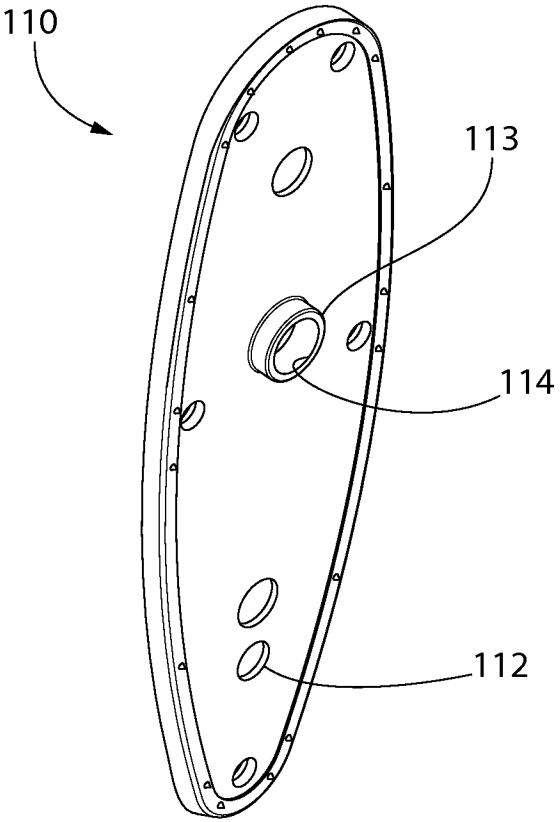
Figure 11B:
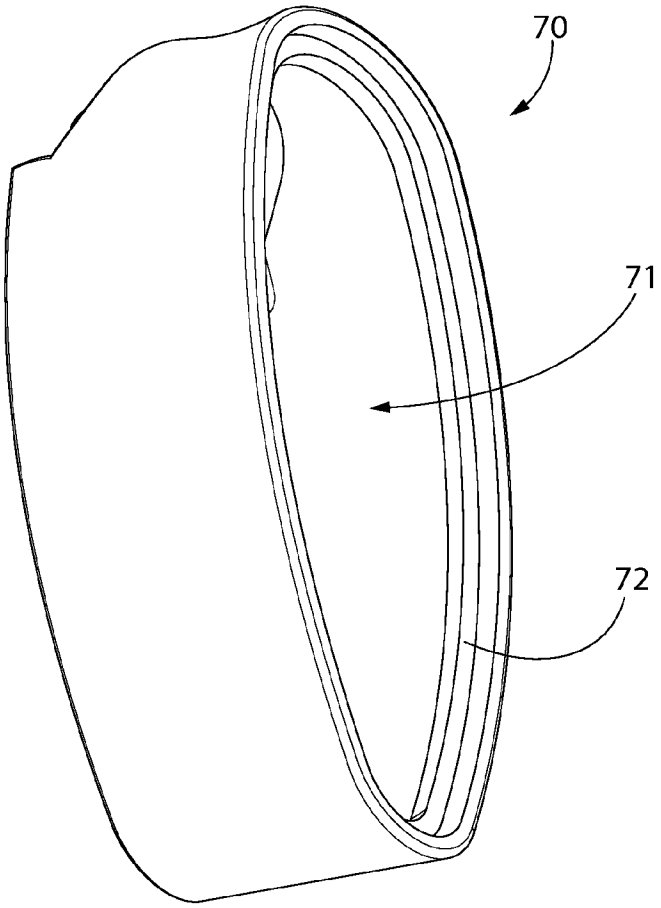
FIGS. 11A-B are rear and front perspective views respectively of the skirt shown in FIGS. 4A-B.
Figure 11A:
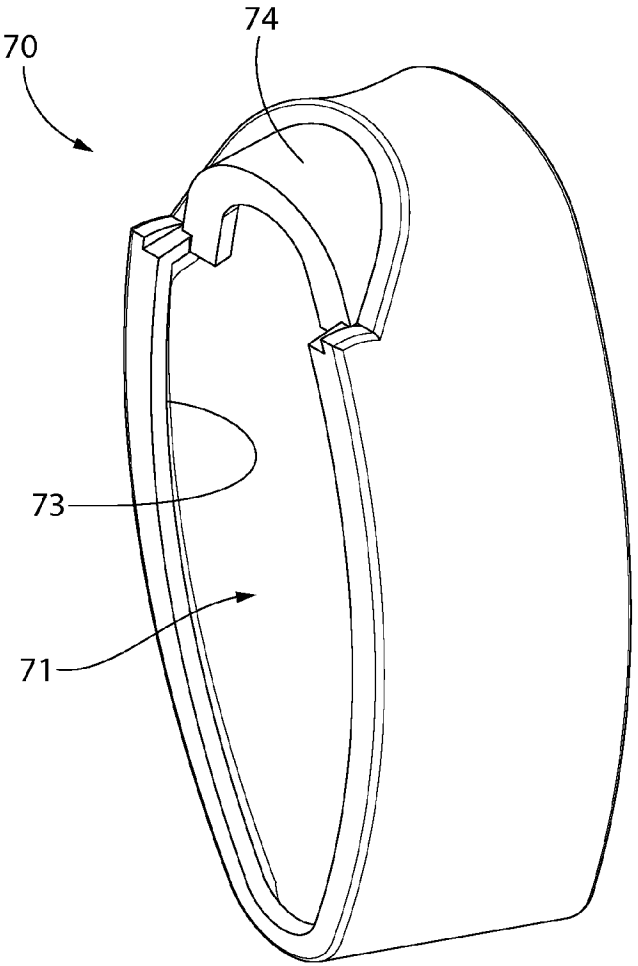

In one embodiment, the butt pad hard insert 42, spacer plate 50, and skirt retaining plate 110 are further mutually configured to form an interlock fit creating a nestable and stackable assembly. Referring to FIGS. 4A, 8A-C, 9A-C, and 10A-B, spacer plate 50 includes a raised front face 51 inset from the peripheral edges of the plate which is insertable into a mating recessed seat 111 formed in the rear surface of skirt retaining plate 110 forming one interlock feature. Another interlock feature is formed by a cylindrical pin 52 on the front face 51 of spacer plate 50 which is insertable through a mating hole 112 formed through the skirt retaining plate 110. The skirt retaining plate 110 includes a cylindrical protrusion 113 which is insertable into a through bore 64 formed in the ram 60 (see also FIG. 6C) which forms an interlock feature and helps properly register the plate 110 in position with the ram.

In one embodiment to access preload adjustment screw 80, protrusion 113 on skirt retaining plate 110 may include an axial through hole 114. Through hole 114 communicates with corresponding vertically elongated through slot 55 in spacer plate 50, elongated through slot 48 in hard insert 42, and vertically elongated through passage 49 in butt pad 40. The combination of through holes and slots are sufficient to provide a linear path for inserting the shaft of a hex key (not shown) into a mating hex socket formed in the enlarged head of the adjustment screw 80 without disassembling the butt pad assembly 40*a* from the buttstock 30.

With continuing reference to FIGS. 4A, 8A-C, 9A-C, and 10A-B, the rear face of spacer plate 50 includes a recessed seat 53 which receives a raised front face 46 inset from the peripheral edges of the hard insert 42 overmolded with butt pad 40 forming an interlock feature. The raised front face 46 projects forward beyond the peripheral portions of the butt pad 40 (see, e.g. FIG. 4A). Another interlock feature is formed by a cylindrical pin 47 on the front face 46 of insert 42 which is insertable into a mating circular socket 54 formed in the rear face of the spacer plate 50. In one embodiment, socket 54 may be coaxially aligned with the pin 52 on the front face of the spacer plate 50.

According to another aspect of the invention, the length of the buttstock 30 and butt pad assembly 40*a* may be lengthened by stacking two or more spacer plates 50 together. The spacer plates 50 with foregoing front and rear face interlock features described above are configured to permit such stacking interlocked arrangement and assembly.

Referring now to FIGS. 4A and 6A-D, the ram 60 includes a vertically oriented mounting flange 61 at the rear against which skirt retaining plate 110 is mounted. In one embodiment, ram 60 further includes an axially elongated cantilevered mounting extension 62 and cylindrical plunger mounting protrusion 63 which is slidably received in tubular sleeve 7. The mounting extension 62 projects in a forward direction from the flange 61 and is slideably coupled to the rear end 35 of buttstock 30. This couples the entire assembly of the butt pad 40 with hard insert 42, spacer 50, face plate 110, and ram 60 (butt pad assembly 40*a*) to the buttstock 30, thereby locating the assembly outboard and rearward of the rear end and main body of the buttstock (see, e.g. FIG. 4A). In one configuration, mounting extension 62 projects farther forward than plunger mounting protrusion 63 to securely mount and balance the butt pad assembly 40*a* to the buttstock. Mounting extension 62 may have a polygonal configuration in one implementation; however, other shapes are possible for use.

In one embodiment, the ram 60 may be movably coupled to the rear end 35 of buttstock 30 via a pair of lateral dowel pins 100. The dowel pins may extend transversely to the longitudinal axis LA and centerline of the buttstock through a pair of axially/horizontally elongated spaced apart slots 101 formed in the right and left sidewalls 31*b*, 31*a* of the buttstock 30 (see, e.g. FIG. 3). The pins 100 in turn pass through mating circular holes 65 in mounting extension 62. This arrangement slideably couples the mounting extension 62 and butt pad assembly 40*a* to the buttstock 30. When the firearm 20 is in the ready-to-fire condition prior to discharge, the rearward biasing force of springs 90 and 91 urges the front and rear dowel pins 100 rearwards towards the rear ends of the slots, thereby locking the ram 60 in position on the buttstock 30. It should be noted that the combination of the dowel pins and their respective elongated slots allows the ram 60 to move linearly with respect to the buttstock 13, as further described herein.

Plunger mounting protrusion 63 includes axial through bore 64 which receives preload adjustment screw 80. The front stem end of screw 80 abuttingly engages a rear spring guide 130 which collectively forms a plunger. In one embodiment, the front end of the screw stem is not fixedly attached to the rear spring guide 130 through the open rear end 127 of the spring sleeve 120. The springs 90 and 91 bias the rear spring guide 130 into engagement with the adjustment screw.

The rear end of the adjustment screw 80 which includes the head is disposed in through bore 64 and accessible for adjusting the preload tension in the compression springs 90, 91 for firing either light or heavy ammunition shell loads which may be shotgun shells in one non-limiting example. Through bore 64 has a stepped configuration with a rear portion of the bore housing the head of the adjustment screw 80 having a larger diameter than the forward portion housing the stem of the screw. Internal threads are disposed in the smaller diameter forward portion of the through bore 64 for rotatably engaging the threaded stem of the screw 80 allowing the position of the plunger to be adjusted and varied by a user. In one non-limiting embodiment, the threads may be formed on a threaded insert 66 such as threaded nuts disposed in the through bore 64. In other embodiments, the front portion of the through bore 64 may be directly threaded instead.

To provide an audible and tactile confirmation of a full adjustment screw 80 rotation to a user, some embodiments may include a spring and ball detent 67. The detent is disposed transversely to the axial through bore 64 and positioned to engage the threaded stem of the adjustment screw 80. Rotating the screw a full 360 produces an audible "click" and tactile feedback sensation to the user when adjusting the preload mechanism.

In one embodiment, plunger mounting protrusion 63 may be connected to mounting extension 62 by an obliquely angled vertical support rib 68 extending between them. The rib 68 which mutually supports both of these cantilevered members and add rigidity to the structure. The rib 68 extends upwards from the top of mounting extension 62 to the plunger mounting protrusion 63. Rib 63 may be wedge or triangular shaped and its height diminishes moving rearward to forward.

The plunger mounting protrusion 63 is insertable into a tubular sleeve 120 disposed in the buttstock 30 which houses the spring assembly. Accordingly, protrusion 63 has a diameter which is sized slightly smaller than the inside diameter of sleeve 120 to allow forward and rearward reciprocating movement therein under recoil after discharging the firearm 20.

Ram 60 may further include an upper thrust block 61*a* and lower thrust block 61*b* formed on the front face or side of mounting flange 61. Thrust blocks 61*a*, 61*b* are raised structures projecting forward from flange 61 that define forward facing thrust surfaces arranged to engage skirt mounting plate 140 disposed on the rear end 35 of buttstock 30 under recoil (see, e.g. FIGS. 4A and 4B). The thrust blocks help evenly distribute the recoil forces to the mounting flange 61 and in turn the butt pad 40 to reduce the felt recoil by a user. Thrust block 61*a* may be disposed on each side of plunger mounting protrusion 63 in one configuration. Thrust block 61*b* may be disposed on each side and the bottom of the mounting extension 62. In one embodiment, the upper longitudinal passage 44*a* used for receiving a threaded fastener to mount the butt pad 40 to the ram 60 may be formed in a barrel-shaped fastener protrusion 60*a* extending forward from the front side or face of the ram mounting flange 61 (see also FIGS. 6A, 6B, and 6D). The fastener protrusion 60*a* may be contiguous in structure with the upper thrust block 61*a* and have a front face which terminates in the same vertical plane as the upper thrust block face so that the fastener protrusion further serves as a thrust surface which distributes the recoil forces. In one embodiment, the lower longitudinal passage 44*b* which receives a threaded fastener may be formed in and through lower thrust block 61*b*.

Ram 60 may be made of any suitably strong material having sufficient rigidity to properly support the entire butt pad assembly 40*a* from the buttstock 30 in a movable manner. In one embodiment, ram 50 may be formed of a polymer for weight reduction, such as 33% glass filled nylon or other plastic. In other embodiments, ram 60 may be formed of a suitable metal such as aluminum, titanium, or other. In one embodiment, ram 60 including mounting extension 62 and plunger mounting protrusion 63 are integrally formed as a single unitary structure such as by molding or casting.

Referring to FIGS. 4A-B, 5, and 11A-B, the skirt 70 is a resiliently flexible tubular member interspersed between the stationary and moving components of the recoil reduction system. In the non-limiting embodiment shown, the skirt 70 is therefore fixedly mounted to both the stationary components and the moving components of the recoil reduction system. The rear end of skirt 70 may be attached to the rear flange of ram 60 and the front end of the skirt may be attached to the rear end 35 of the buttstock 30 as shown. Threaded fasteners may be used to connect skirt 70 to both the buttstock 30 and rear flange 61 of ram 60 in some embodiments. The rear end of skirt 5 may include an inwardly extending lip 72 which is trapped between the skirt retaining plate 110 and rear flange 61 of ram 60 as shown to mount the skirt to the stationary components (i.e. butt pad assembly 40*a*). Lip 72 is received in a complementary configured and arranged annular peripheral recess 69 formed on the rear face of the ram flange 61 (see, e.g. FIGS. 6B and 6C).

The front end of skirt 70 includes an inwardly extending lip 73 which is trapped between the rear end 35 of buttstock 30 and the skirt mounting plate 140. The plate 140 may be secured to the rear end of the buttstock 30 via threaded fasteners. Skirt retaining plate 140 includes a vertically elongated slot 141 of sufficient dimension to receive mounting extension 62 and plunger mounting protrusion 63 of the ram 60 therethrough for slidable movement inside the buttstock. In one configuration, the slot 141 may have a keyhole shape to complement the transverse cross-sectional shape of the mounting extension 62 and plunger mounting protrusion 63. In one implementation, skirt 70 may be overmolded onto skirt mounting plate 140 forming an integral assembly.

Other suitable securement means may be used for attaching skirt 70 to the buttstock 30 and ram 60 including for example adhesives, rivets, etc. Accordingly, the invention is not limited by the method of attachment used.

Figure 4A:
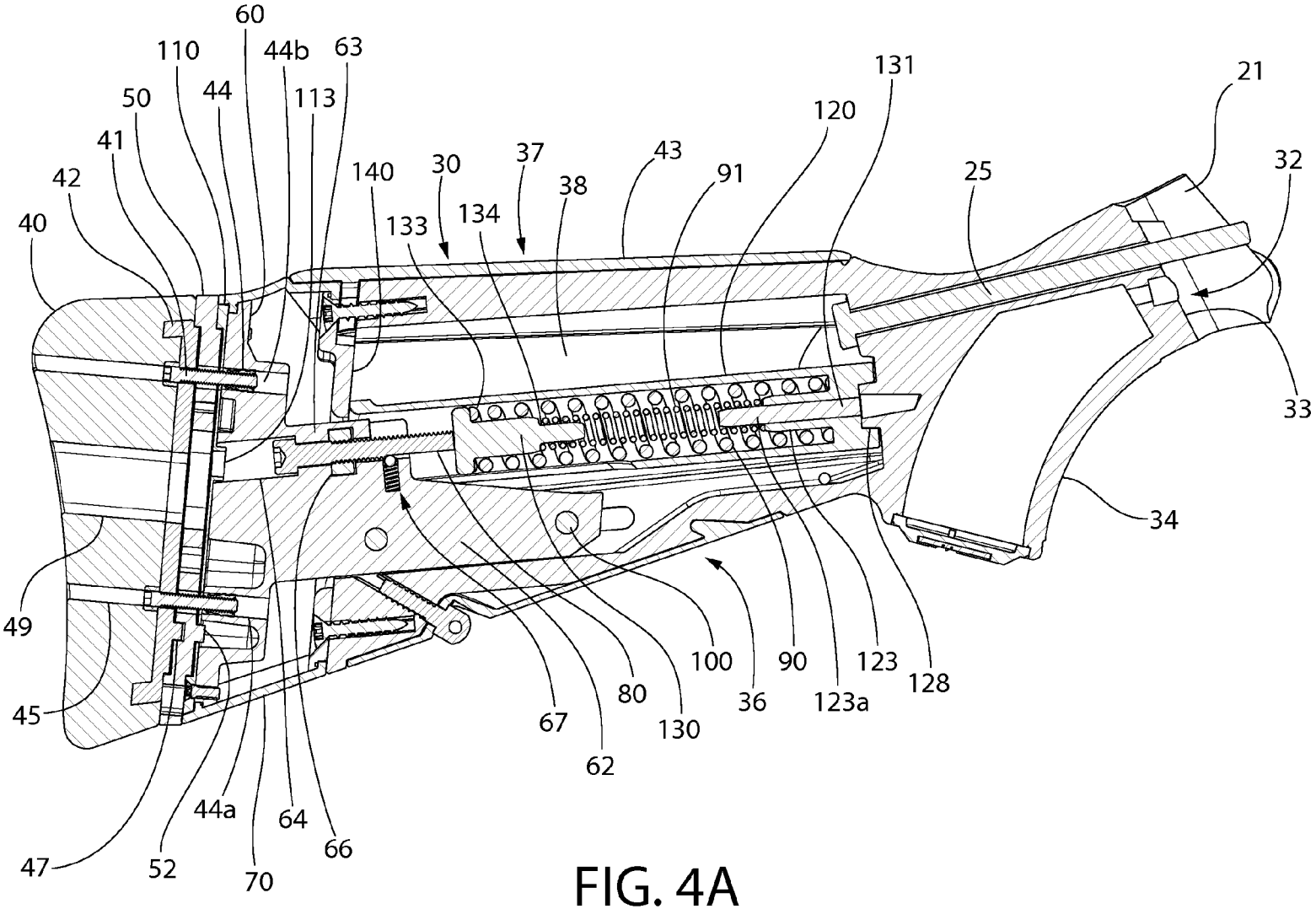
FIG. 4A is a cross-sectional view thereof showing the buttstock in a forward non-recoil position.
Figure 4B:
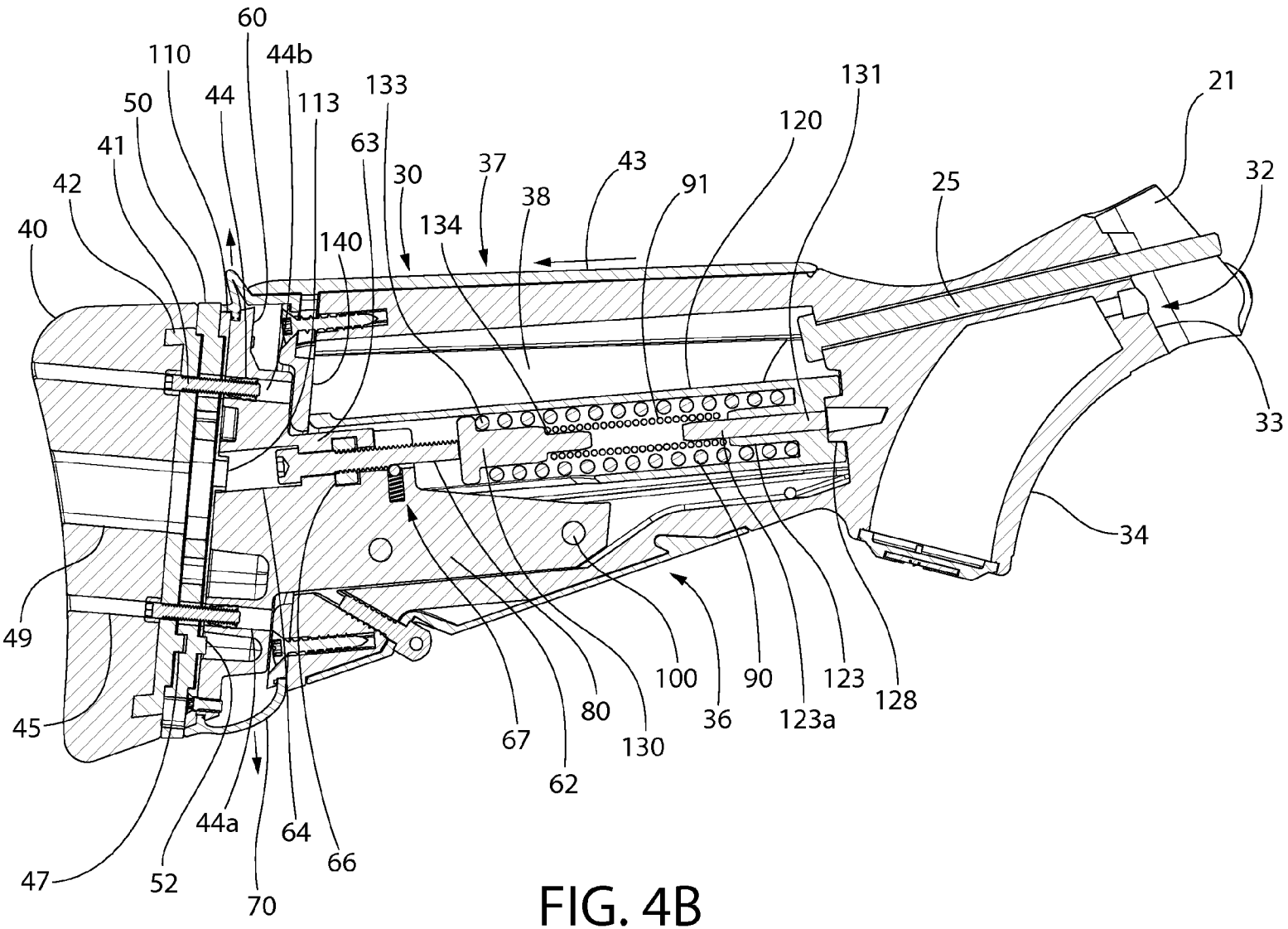
FIG. 4B is a cross-sectional view thereof showing the buttstock in a rearward recoil position.

Skirt 70 defines a rearwardly open internal chamber 71 into which ram 60 may be inserted through the rear end of the skirt, as best shown in FIGS. 4A-B. The front top portion of the skirt may have a recessed area 74 which receives and complements the shape of the rear end of the comb 43 (see also FIG. 11A).

In one embodiment, the skirt 70 is made of a resiliently deformable elastomeric material having an elastic memory which may be temporarily deformed and then returns to its original shape. Skirt 70 serves as a flexible protective cover to enclose an axial gap G between the rear flange of ram 4 and rear end of the buttstock, thereby acting as a bellows or expansion joint therebetween. In one embodiment, without limitation, skirt 70 may be made of rubber. Other suitable elastomeric materials however may be used including for example various polymeric and thermoplastic elastomers suitable for the application.

Referring now to FIGS. 1-5, the moving components generally comprise comb 43, spring sleeve 120, front spring guide 132, heavy spring 90, light spring 91, and buttstock 30. The comb 43 may be removable and detachably mounted to the top of the buttstock 30. In one embodiment, the buttstock 30 may be removably coupled to the receiver 21 via a threaded stock bolt 25 which engages a threaded socket formed in the rear of the receiver in a known manner. During recoil, the buttstock 30 therefore travels rearward with the receiver 21 and the barrel 23 (coupled to the front of the receiver) as a unit.

Referring also to FIGS. 7A-D, the spring sleeve 120 has a hollow cylindrical or tubular body which houses the spring mechanism (i.e. springs 90, 91) disposed therein in an axially elongated interior passage or receptacle 121. In one embodiment, sleeve 120 has a partially closed front end 126 and an open rear end 127 through which the spring assembly 90, 91 and plunger assembly (i.e. rear spring guide 130, adjustment screw 80, and plunger mounting protrusion 63) may be slideably inserted. In one embodiment, the front end of sleeve 120 includes a forwardly open socket 125 in which a cylindrical protrusion or boss 128 of the buttstock 30 is at least partially received for positioning the sleeve. In one embodiment, the boss 128 may be frustoconical shaped and the socket 125 is complementary configured to have a mating frustoconical shape. In other possible embodiments, the boss and socket may have straight substantially parallel sides. A front wall 129 separates the socket 125 from the interior receptacle 121 except for a longitudinal passage 124 extending into the socket and through a cylindrical spring mounting protrusion 123 disposed in the interior receptacle. A cylindrical rod 123*a* is received in the passage 124 (see, e.g. FIG. 4A) which forms part of the front spring guide 131, as further described herein.

In one embodiment, the sleeve 120 is held in position in the buttstock 13 by operation of the spring assembly alone which biases the front wall of the sleeve into abutting engagement with the boss 128 as shown. In other possible embodiments, fasteners or pins may be used in addition to or instead of relying on the spring assembly secure the sleeve to the buttstock. Other ways of mounting the sleeve in the buttstock are possible.

Figure 12:
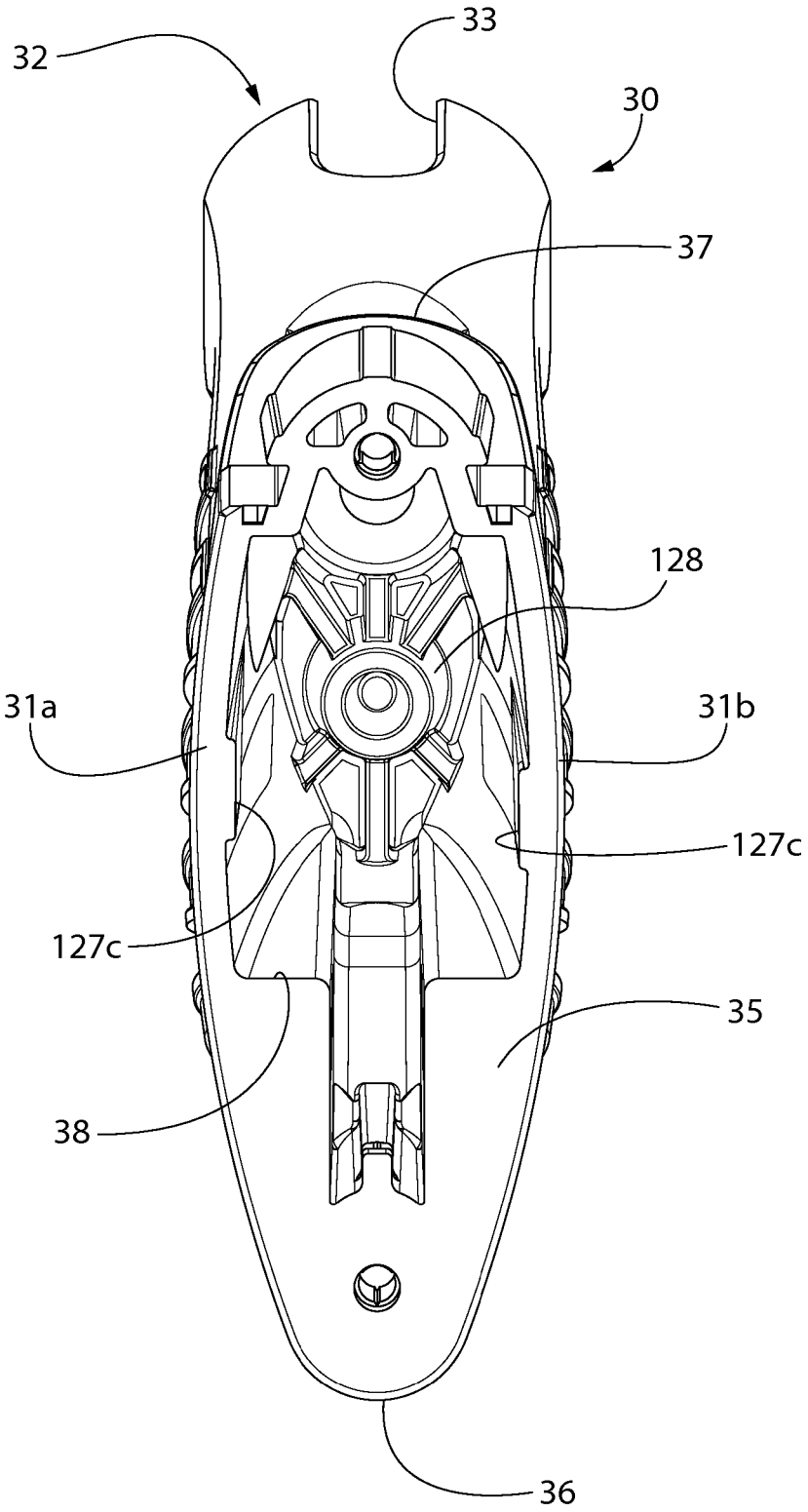
FIG. 12 is a rear view of the buttstock with butt pad assembly and skirt mounting plate removed.

Sleeve 120 has a diameter dimensioned to slidably receive the plunger assembly of ram 60 which may have a complementary cylindrical shape. Sleeve 120 may include a vertical flange 127*a* on its rear end 127 disposed at an angle between 0 and 90 degrees to the cylindrical body of the sleeve. The flange 127*a* is configured to engage a portion of the rear end 35 of the buttstock 30 such as skirt mounting plate 140 to properly position the rear end of the sleeve for receiving the ram plunger assembly (i.e. rear spring guide 130, adjustment screw 80, and plunger mounting protrusion 63) into the sleeve. The flange 127*a* may include a pair of opposing lateral cutouts 127*b* which engage mating longitudinal protrusions 127*c* formed in the sidewalls 31*a*, 31*b* and cavity 38 of the buttstock 30 (see also FIG. 12).

In one embodiment, a longitudinally extending slot 122 is formed in the bottom of the tubular spring sleeve 120 extending from the rear end 127 forward for a distance. The slot slideably receives the support rib 68 of the ram 60 thereby allowing for full movement of the plunger assembly inside the tube from the rear end.

Figure 5:
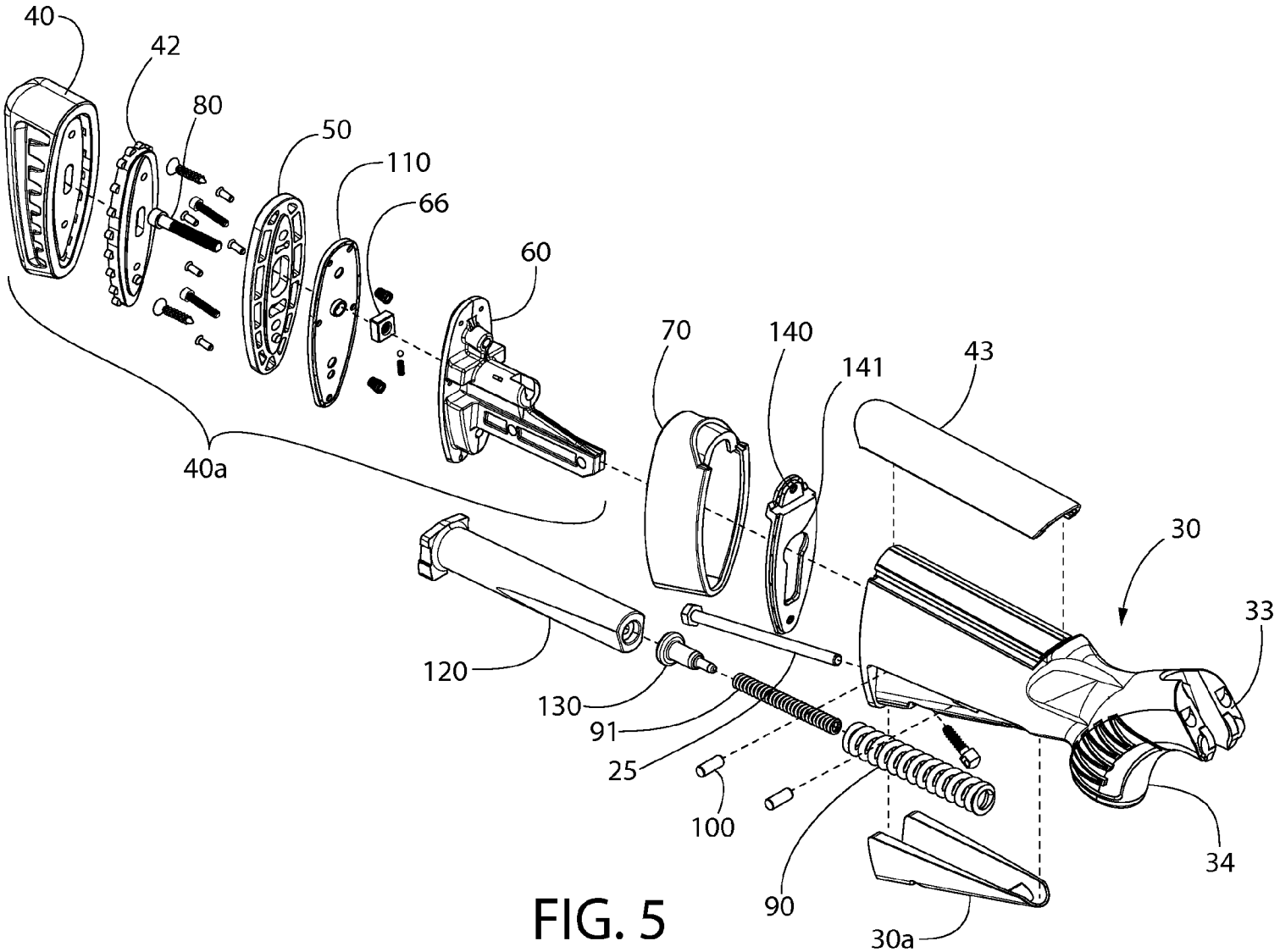
FIG. 5 is an exploded perspective view thereof.

The spring assembly includes an inner light spring 91, outer heavy spring 90, and opposing front and rear spring guides 131, 130 (see FIGS. 4 and 5). In one embodiment, the springs are coiled compression springs. Other suitable type springs may be used. The inner and outer springs 131, 130 are concentrically aligned and arranged with each other such that the inner spring nests inside the outer spring. The rear spring guide 130 may be cylindrical in shape and includes an enlarged head having a diameter slightly smaller than the inside diameter of the sleeve receptacle 121 and a stem of smaller diameter than and projecting perpendicular to the head. The stem may have a stepped configuration defining two shoulders on different diameter portions—a first shoulder 133 located between the head and larger diameter portion of the stem and a second shoulder 134 located between the larger diameter portion of the stem and a smaller diameter portion as shown. The first shoulder 133 is arranged to abutting engage the ends of the outer heavy spring 90 and the second shoulder 134 is arranged to engage the ends of the inner light spring 91. The outer heavy spring 90 receives the larger diameter portion of the stem therein and the smaller diameter portion of the stem receives the inner light spring 91 therein.

The front spring guide 131 comprises rod 131 which is inserted into the front end of the light spring 91 and the spring mounting protrusion 123 of the spring sleeve 120 which is inserted into the front end of the heavy spring 90. The rod 131 and protrusion 123 collectively form the front spring guide 131 which together provide the same configuration and profile as the rear spring guide 130.

By utilizing the concentrically arranged pair of the lighter inner spring 91 and heavier outer spring 90 (referring to the spring force of each spring), the desired total spring force contributed by both springs is achieved in a more compact axial space of the sleeve. This allows the buttstock to be made shorter and more compact if desired. In other embodiments, a single spring may be provided if the desired spring force can be obtained with the space allocated in the buttstock for the spring assembly.

According to one aspect of the invention, a spring preload adjustment mechanism is provided which allows a user to change the spring preload to accommodate firing light or heavy shotshell loads which will each generate different magnitudes of recoil force. When firing a heavy load, the spring preload should preferably be increased to maximize the spring force produced and dampening effect of the springs 90, 91 to counteract a larger recoil force. The preload force stored in the spring will act against the recoil force applied during firing. When a light load is fired which will produce a smaller recoil force, the spring preload should preferably be decreased so that a comparatively smaller spring force is produced to effectively dampen the lesser recoil force. If the preload and spring force is at a maximum when firing a light load, the dampening effect may be too little which can transfer a disproportionately larger amount of recoil force to the shoulder of the user. In one example, without limitation, the adjustment mechanism may be designed with approximately 125 lbs. of preload. Other suitable spring preloads may be used.

With continuing reference to 12, the preload adjustment mechanism may comprise preload adjustment screw 80 which threadably engages the threaded through bore 64 disposed near the front of the cylindrical plunger mounting protrusion 63 of ram 60. The adjustment screw 80 which is linearly movable by rotating the screw in opposing direction allows the position of the rear spring guide 130 to be changed by a user with respect to the spring sleeve 120 prior to firing the firearm 20. This affects the degree to which the springs 90, 91 are either compresses or relaxed/expanded which corresponds to different spring preload conditions for matching the preload to the type of ammunition (light or heavy) being fired. The preload is infinitely adjustable to optimize and lessen the felt recoil experienced by the user.

In use, the preload may be increased for firing heavy loads by rotating the adjustment screw 80 in a first direction to advance the stem in an axially forward direction. This moves the rear spring guide 130 correspondingly forward closer to the front spring guide 131, thereby compressing the springs 90, 91. To decrease the preload for lighter loads, the adjustment screw is rotated in a second opposite direction to retract the stem in an axially rearward direction. This increases the distance between the front and rear spring guides 131, 130, thereby expanding or decompressing the springs. The adjustment screw 80 may therefore be linearly translated through and set at a plurality of possible preload adjustment positions or conditions to match the load type being fired. In one embodiment, through passage 49 in butt pad 40 allows the user to operate the preload adjustment screw with an elongated tool such as a hex key or screw driver without removing the butt pad from the buttstock 30 (see, e.g. FIG. 2).

A method for operating the recoil reduction system will now be described with general reference to FIGS. 1-5. The user may first optionally adjust the preload on the spring assembly in the manner described above to fit the type of load being fired (e.g. light or heavy). The buttstock is in a forward rest or inactive axial position (non-recoil position) shown in FIG. 4A. When the firearm is discharged, the buttstock and its group of "moving" components" moves rearward with respect to the "stationary" group of components (see directional arrow in FIG. 4B). The recoil or butt pad 40, spacer plate 50, and ram 60 remain relatively immobile being buttressed against the user's shoulder. The buttstock 30 is at least partially guided via sliding engagement between the dowel pins 100 in the mounting extension 62 and the longitudinal slots 101 in the sidewalls of the buttstock. The dowel pins 100 each move forward in the slots 101 to a front position in the slots from a prior rear position before firing.

The spring sleeve 120 and front spring guide 131 move rearward with respect to the rear spring guide 130, adjustment screw 80, and ram plunger mounting protrusion 63 ("plunger assembly") which are stationary. The plunger assembly collectively moves farther forward and deeper into the sleeve 120 during the recoil event. The inner light and outer heavy springs 91, 90 become compressed between the axially spaced part and opposing spring guides 130, 131 to at least partially absorb and dampen the recoil force and felt recoil by the user. The resilient skirt 70 radially expands outwards as the rear end 35 of the buttstock 30 moves towards the flange 61 of the ram 60, thereby decreasing the gap formed therebetween. The upper and lower thrust blocks 61*a*, 61*b* abuttingly engage the rear end 35 (i.e. skirt mounting plate 140) of the buttstock 30 which arrests rearward movement of the buttstock assembly. This is shown in the rearward recoil position of the buttstock in FIG. 4B.

When the buttstock has moved a maximum amount to the rearward active axial recoil position, the compressed spring assembly 90, 91 expands to its original pre-firing position thereby returning the buttstock 30 back to the inactive forward non-recoil position shown in FIG. 4A. This foregoing recoil cycle is repeated each time the firearm is fired.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. An adjustable recoil reduction system for a firearm, the system comprising:

an axially extending buttstock having a longitudinal stock axis, a rear end, a front end, and a longitudinally extending internal cavity;

a ram including a cantilevered mounting extension, the mounting extension projecting forward from the ram through the rear end of the buttstock into the internal cavity, the mounting extension slideably coupling the ram to the buttstock;

a butt pad coupled to the ram;

an adjustable plunger assembly comprising a rear spring guide disposed in the buttstock and a preload adjustment screw rotatably coupled to the ram and engaging the rear spring guide, the plunger assembly being movable forward and rearward in the buttstock; and a first compression spring mounted inside the buttstock and engaged by the rear spring guide, the plunger assembly operating to compress the first compression spring when the buttstock moves rearward relative to the plunger assembly;

wherein rotating the adjustment screw in a first direction advances the rear spring guide and compresses the first compression spring for setting a first preload condition, and rotating the adjustment screw in an opposite second direction retracts the rear spring guide and allows the first compression spring to expand for setting a second preload condition;

wherein when a rearward acting recoil force is generated by discharging the firearm, the buttstock moves rearward and compresses the first compression spring against the plunger assembly to absorb at least a portion of the recoil force.

2. The system according to claim 1, wherein the assembly is inserted deeper into the buttstock when the buttstock moves rearward than when the buttstock is in a forward non-recoil position.

3. The system according to claim 1, further comprising a tubular spring sleeve disposed inside the buttstock which holds the first compression spring therein, the plunger assembly movably inserted in the spring sleeve.

4. The system according to claim 3, wherein a front end of the spring sleeve includes a socket engaged with a cylindrical boss formed in the internal cavity of the buttstock.

5. The system according to claim 1, further comprising an elastomeric skirt coupled to the rear end of the buttstock and the ram, the skirt compressing and radially expanding when the buttstock moves rearward.

6. The system according to claim 1, further comprising a second compression spring concentrically arranged around the first compression spring, the rear spring guide compressing both the first and second compression springs when the buttstock moves rearward.

7. The system according to claim 5, further comprising a front spring guide, the front and rear spring guides each including a first shoulder engaging the first compression spring and a second shoulder engaging the second compression spring.

8. The system according to claim 1, wherein the ram includes a plunger mounting protrusion comprising internal threads which rotatably engage the preload adjustment screw.

9. The system according to claim 1, further comprising a vertically elongated spacer plate disposed between the butt pad and the ram.

10. The system according to claim 1, wherein the butt pad includes a through passage that provides access to the preload adjustment screw without uncoupling the butt pad from the ram.

11. The system according to claim 1, wherein the buttstock includes an axially spaced apart pair of longitudinal slots each of which slideably engage a transverse dowel pin extending through the mounting extension of the ram to slideably couple the mounting extension to the buttstock.

12. An adjustable recoil reduction system for a firearm, the system comprising:

a buttstock extending rearward from a receiver, the buttstock having a longitudinal stock axis, a rear end, a front end, and an internal cavity extending between the front and rear ends;

a spring assembly disposed in the buttstock, the spring assembly comprising a tubular sleeve fixedly mounted inside the buttstock, a first spring inside the sleeve, a second spring inside the sleeve concentrically arranged around the first spring, a rear spring guide engaged with the first and second springs, and a front spring guide engaged with the first and second springs;

a butt pad assembly comprising a butt pad configured for placement against a shoulder of a user and a ram coupled to butt pad, the butt pad assembly movably coupled to the buttstock;

an axially elongated preload adjustment screw threadably coupled to the ram and having a front end engaging the rear spring guide to fix a position of the rear spring guide relative to the sleeve, the preload adjustment screw movable forward and rearward relative to the buttstock by rotating the preload adjustment screw in opposing directions;

wherein rotating the preload adjustment screw in a first direction compresses the first and second springs to set a first preload condition, and rotating the preload adjustment screw in an opposite second direction expands the first and second springs to set a second preload condition;

wherein when a rearward acting recoil force is generated by discharging the firearm, the buttstock moves rearward and the rear spring guide compresses the first and second springs thereby absorbing at least a portion of the recoil force.

13. The system according to claim 12, wherein the first and second springs expand when the recoil force is removed via the buttstock moving forward.

14. The system according to claim 12, wherein the butt pad assembly remains stationary against the user's shoulder when the firearm is discharged and the buttstock and spring assembly move rearward.

15. The system according to claim 12, wherein the rear spring guide slides forward in the sleeve under the rearward acting recoil force.

16. The system according to claim 12, wherein the ram includes a vertically oriented mounting flange having a height substantially coextensive with a height of a front end of the butt pad.

17. The system according to claim 12, further comprising a spacer plate interspersed between the butt pad and the ram.

18. The system according to claim 12, wherein the buttstock further includes a sidewall and an axially elongated slot disposed in the sidewall, and further comprising a transverse pin mounted inside the buttstock inserted through the slot and connected to a forward projecting mounting extension disposed on the ram, the pin and slot acting to movably couple the butt pad assembly to the buttstock.

19. The system according to claim 12, further comprising an elastomeric skirt coupled to the rear end of the buttstock and the ram, the skirt compressing and radially expanding when the buttstock moves rearward.

20. The system according to claim 12, further comprising a vertically elongated spacer plate disposed between the butt pad and the ram.

21. The system according to claim 12, wherein the ram includes a thrust block which engages a vertically oblong plate attached to the rear end of the buttstock when the buttstock moves rearward under recoil.

22. A method for reducing recoil in a firearm, the method comprising:

providing a firearm including a buttstock, a butt pad assembly movably coupled to a rear end of the buttstock, a coiled first spring disposed inside the buttstock, a second spring concentrically arranged around the first spring, and an adjustable plunger mechanism comprising a rear spring guide engaging the compression spring and a preload adjustment screw rotatably coupled to the butt pad assembly and engaging the rear spring guide, the buttstock being in a forward non-recoil position spaced apart from the butt pad assembly by a first distance;

rotating the preload adjustment screw in a first direction which advances the rear spring guide forward in the buttstock;

compressing the first spring by the advancement of the rear spring guide to a first preload condition;

discharging the firearm;

moving the buttstock in a rearward direction under recoil closer to the butt pad, the buttstock being in a rearward recoil position spaced apart from the butt pad assembly by a second distance smaller than the first distance;

the buttstock compressing the first spring by movement in the rearward direction;

expanding the first spring; and returning the buttstock to the forward non-recoil position;

wherein the step of compressing the first spring also compresses the second spring.

23. The method according to claim 22, further comprising rotating the preload adjustment screw in a second direction which retracts the rear spring guide and expands the first spring.

* * * * *